US006093069A

United States Patent [19]

Schelfhout

[11] Patent Number: 6,093,069

[45] Date of Patent: Jul. 25, 2000

[54] LOW WATCH CIRCLE BUOY SYSTEM

[75] Inventor: Stephen J. Schelfhout, Lynn Haven, Fla.

[73] Assignee: The United States of America as represented by the Secretary of the Navy, Washington, D.C.

[21] Appl. No.: 09/313,867

[22] Filed: May 17, 1999

[51] Int. Cl.[7] ..... B63B 22/00

[52] U.S. Cl. ..... 441/11; 441/24; 441/6

[58] Field of Search ..... 441/6, 7, 11, 23, 441/24, 25, 26, 27; 367/3–5

[56] References Cited

U.S. PATENT DOCUMENTS

| | | | |
|---|---|---|---|
| 1,160,122 | 11/1915 | Amberger | 441/11 |
| 3,295,153 | 1/1967 | Dessau | 441/11 |
| 5,951,346 | 9/1999 | Woodall, Jr. | 441/7 |

*Primary Examiner*—Ed Swinehart

*Attorney, Agent, or Firm*—Harvey A. Gilbert; Donald G. Peck

[57] ABSTRACT

A low watch circle buoy system (LWCBS) uses global positioning system (GPS) P(Y) code coordinate sensing and transmission to mark its position in water depths up to 40 feet to a positional accuracy of 3 meters or less. LWCBS maintains this position with a flotation unit on the water's surface that transmits signals representative of its location. A submerged unit is affixed to a surface at the bottom of the body of water and has outwardly reaching extensions that lie adjacent the surface. The extensions are tethered to the flotation unit by lines that are each connected between a distal part of each of the extensions and the flotation unit. A spool on each distal part each deploys and secures one of the lines to maintain the flotation unit substantially vertically above the submerged unit. These tether lines limit the range (watch circle) the flotation unit may traverse on the water.

19 Claims, 4 Drawing Sheets

LOW WATCH CIRCLE BUOY SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Accurately marking the position of a sunken object in water has been a difficult task. Usually a position is marked by placing a buoy as close as practicable to the position's location. The buoy most currently used is either free floating or is tethered via a single line to an anchor on the surface at the bottom of the water. Unfortunately this type buoy does not sufficiently constrain the motion of a buoy on the top of the water over a period of time since its position will vary within a large circle (watch circle) that is defined by the water current, tides, and length of the buoy's tether to the anchor.

The effects of current, tides, and length of the buoy's tether may make the size of the watch circle considerable in very shallow water (VSW) between 10 and 40 foot water depths, in the surf zone (SZ) between 0 and 10 foot water depths, and in the beach zone (BZ). This lack of definiteness is a disadvantage and can disrupt some operations because the actual position that the buoy is intended to mark cannot be exactly determined by visual means.

Some recent buoy system designs have incorporated global positioning system (GPS) transmitters so the buoy's position can be transmitted in GPS coordinates. However, because the buoy still has a large variance in its position, GPS coordinates of the buoy's position would have to be monitored over a long time period and averaged to determine the position it was intended to mark. This too may be flawed since a relatively constant unidirectional current flow over the same long period of time might still give an erroneous indication of where the correct buoy position is.

Thus, in accordance with this inventive concept, a need has been recognized in the state of the art for buoy systems that maintain and identify positions visually on the surface of the water and transmit position data in GPS P(Y) code coordinates over a period of time such that reported positions are within three meters of actual positions.

SUMMARY OF THE INVENTION

The present invention provides a buoy having a flotation unit on a body of water to transmit signals representative of the flotation unit's location. The flotation unitic connected via four lines to a submerged unit that is affixed to the bottom of the body of water and has extensions outwardly reaching from a central portion adjacent the surface. The four lines that are each connected between a distal part of each of the extensions and the flotation unit limit the range the flotation unit may traverse on the water's surface.

An object of the invention is to provide a self-contained position locating system deployable from various surface or air platforms.

Another object of the invention is to provide a position locating system deployable in water depths from 40 feet to the top of the beach.

Another object of the invention is to provide a position locating system manually deployable overboard without requiring any new or additional equipment.

Another object of the invention is to provide a position locating system maintaining a displayed and transmitted position to within three meters of the actual position over a long time period, regardless of the water currents and/or tides.

Another object of the invention is to provide a position locating system indicating a position visually and transmitting GPS coordinates representative of less than 3 meters from its actual position.

Another object of the invention provides a position locating system having a submerged unit and a floatation unit to indicate a position visually and transmitting GPS coordinates representative of less than 3 meters from its actual position.

These and other objects of the invention will become more readily apparent from the ensuing specification when taken in conjunction with the appended claims.

DESCRIPTION OF THE PREFERRED EMBODIMENT

Figure 1:
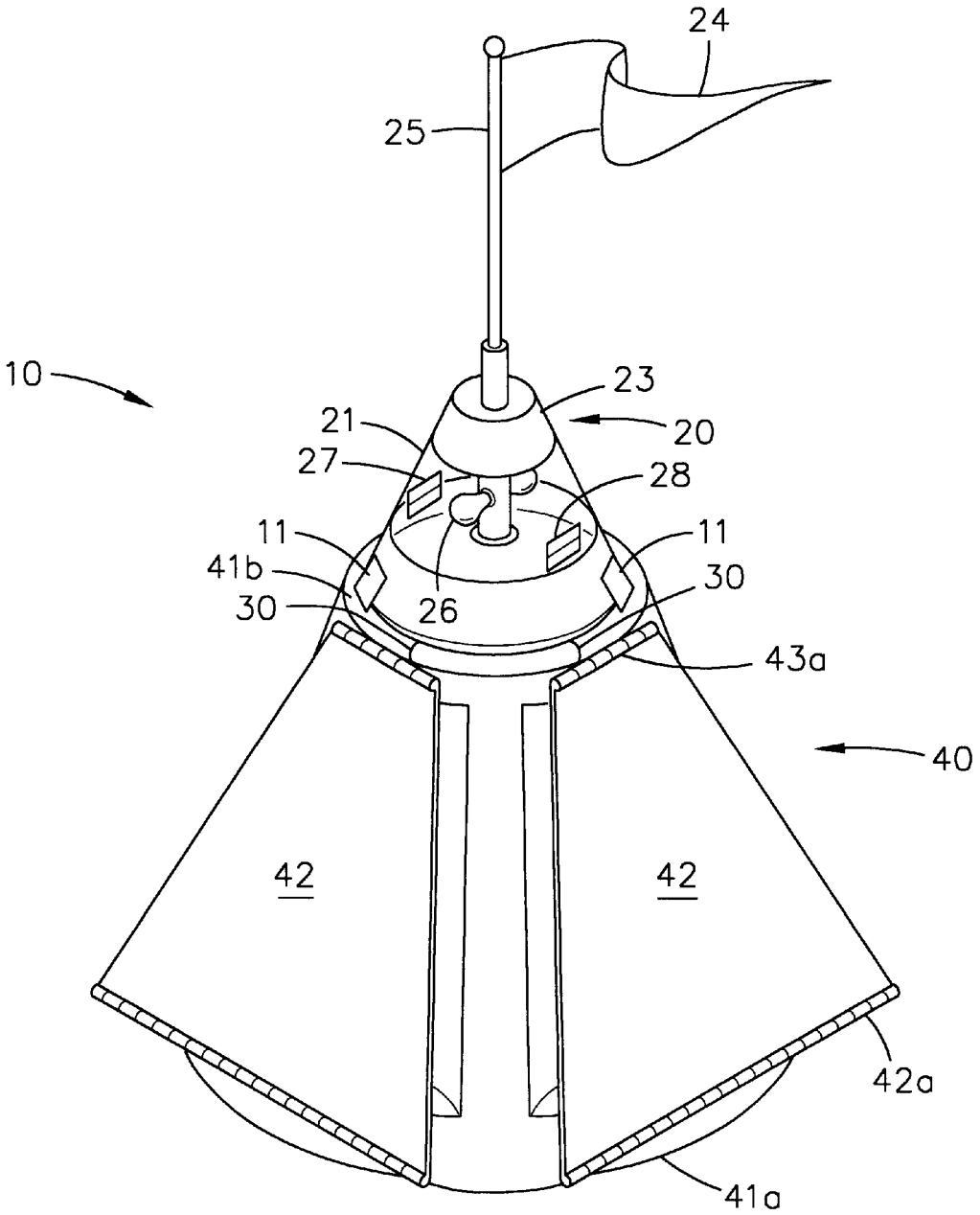
FIG. 1 isometrically shows the buoy system before deployment.

Referring to FIG. 1, low watch circle buoy system (LWCBS) 10 holds and maintains a precise position over prolonged periods of time and is easily identifiable from distant water and air borne observation craft. Buoy system 10 also has the capability to transmit data representative of its position in GPS coordinates for identification and tracking from distances extending over the horizon. Buoy system 10 is a relatively compact package capable of being deployed by one man in a body of water to accurately mark the location of a site. Aircraft or boats may be used to transport buoy system 10, and when it is dropped overboard and deployed, buoy system 10 quickly provides active and passive means for visually indicating the location of the site, and transmits coordinate signals representative of this location with an accuracy of within 3 meters from its actual position.

Figure 2:
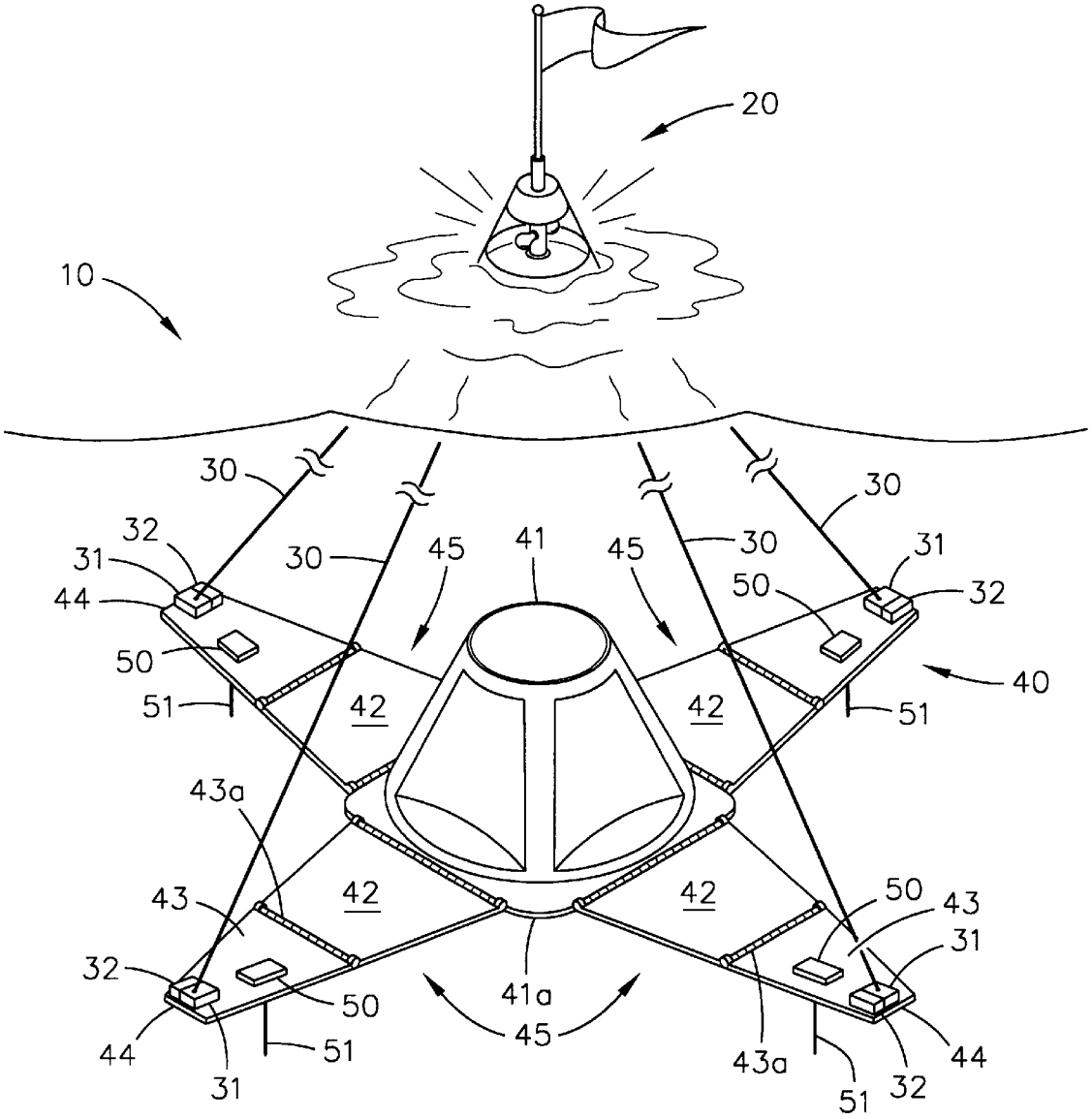
FIG. 2 isometrically shows the buoy system having its flotation unit on the surface and its submerged unit anchored on the bottom.
Figure 3:
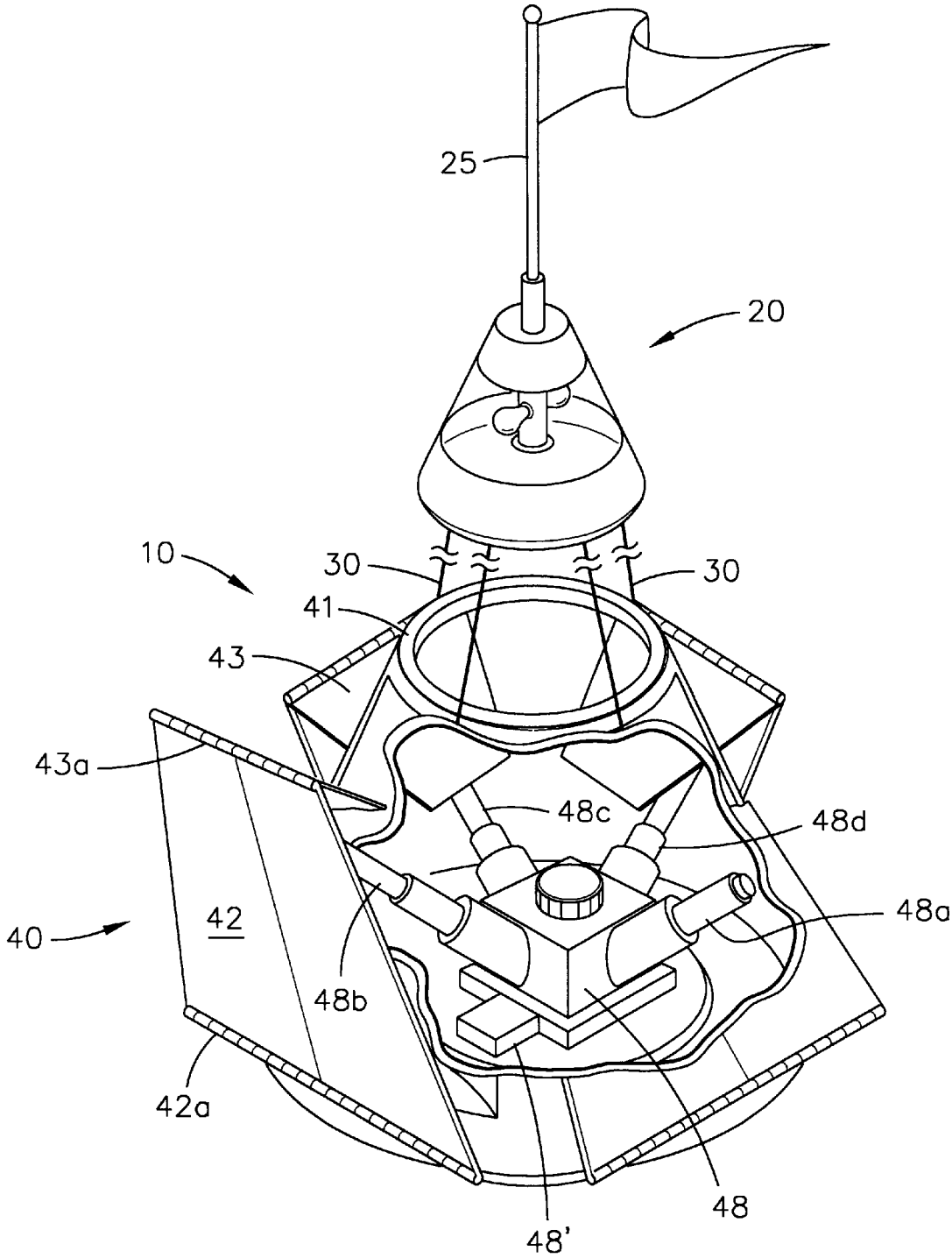
FIG. 3 depicts partial separation and extension of components.

Referring also to FIGS. 2 and 3, as buoy system 10 is deployed into the water, one or more internal or external release mechanisms 11 cause flotation unit 20 and submerged unit 40 to disengage in response to self-contained water sensors or timers, or remote signals, for examples. Consequently, buoy system 10 separates into flotation unit 20 and submerged unit 40 joined by a plurality of wire rope or synthetic lines 30. Optionally, release mechanisms 11 may also be connected to a piston-like extension or impact sensitive switch (not shown) that may extend through or be mounted on the bottom of submerged unit 40. This may enable separation of flotation unit 20 and submerged unit 40 to occur when buoy system 10 contacts the floor. Other electrical and mechanical coactions may be initiated at this time as mentioned below.

Irrespective which type of release mechanism 11 is chosen, flotation unit 20 is positively buoyant to remain at or float to the surface of the water, and submerged unit 40 is negatively buoyant to sink to the bottom of the body of water and rest on the surface or floor of the marine topography. As submerged unit 40 sinks beneath flotation unit 20 or shortly after submerged unit 40 comes to rest on the floor, arms 45 each made up from hinged first panel 42 and hinged second panel 43 are displaced from framework 41 of submerged unit 40. Arms 45 are coupled to and displaced by hydraulic pump assembly 48 having a self-contained battery power supply 48'.

Each of tether lines 30 is payed-out from spring-actuated spools 31 mounted on flotation unit 20, and the opposite ends of lines 30 are connected to distal ends 44 of arms 45 of submerged unit 40; or each of tether lines 30 is payed-out from spools 31 mounted on distal ends 44 of arms 45 of submerged unit 40, and the opposite ends of lines 30 are connected to flotation unit 20. In either case, tether lines 30 couple the two units together. Each spool 31 is spring biased and may have an interlocking rachet-and-pawl-like mechanism 32. Mechanism 32 permits spool 31 to rotate and release line 30 only as submerged unit 40 sinks beneath flotation unit 20 (or as flotation unit 20 floats upward to the water surface) and pulls line 30 from spool 31. When submerged unit 40 comes to rest on the floor and flotation unit 20 begins to float on the water's surface, the two units are virtually vertically aligned. At this time, lines 30 stop from being pulled from spools 31, and the pawl of each mechanism 32 locks each spool 31 to prevent additional line 30 from being payed-out.

Figure 5:
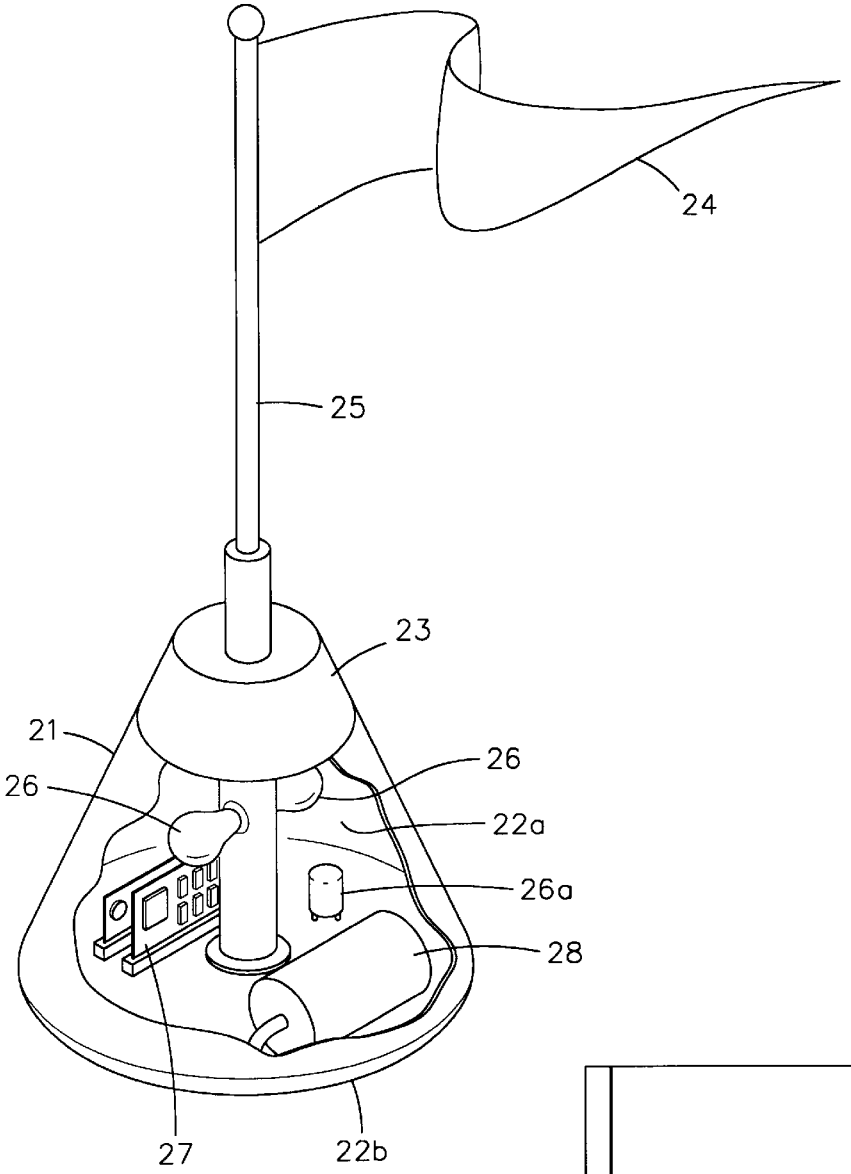
FIG. 5 isometrically shows the flotation unit and its components.

Referring also to FIG. 5, flotation unit 20 may have transparent acrylic window 21 that seals-off interior chamber 22*a*, and additional flotation material 22*b* may be added to assure that flotation unit 20 responsively floats to and remains on the surface of the water. Flotation unit 20 has neon paint and/or reflective surfaces 23 of other electromagnetic energy radiation, such as infrared and ultraviolet, and flag 24 on combination mast-and-GPS-antenna 25 also passively aids visual location of buoy system 10. Active means for visual location are provided in chamber 22*a* and may include electromagnetic energy radiators such as blinking or steady-state lights radiating visible, ultraviolet, and infrared light from appropriate bulbs 26. These active means may be actuated by signals from a self contained internal timer or radio receiver 26*a* in response to signals from a remote signal source.

Flotation unit 20 also has a global positioning system (GPS) having antenna 25 connected to GPS transmitter-receiver 27. This allows the position of buoy system 10 to be determined in coordinates, such as GPS P(Y) code coordinates, and transmitted to remote craft and/or monitoring systems. After a preset delay, flotation unit 20 pushes-up mast 25 that functions as the GPS antenna and support for flag 24. When mast 25 reaches full height, flag 24 is unfurled. Flotation unit 20 begins to initialize GPS receiver portion of GPS transmitter-receiver 27 and power-up both the GPS transmitter portion of GPS transmitter-receiver 27 and bulbs 26. After GPS receiver portion locks onto the GPS satellite constellation in view, transceiver 27 may begin to transmit data representative of its location. Batteries 28 provide power for GPS transmitter-receiver 27, bulbs 26 and other operations.

Submerged unit 40 has a heavy-duty framework 41 made from heavy, negatively buoyant material, such as stainless steel or other corrosion resistant metal that will remain on the floor and partially acts as an anchor. Framework 41 supports battery power source 48' and hydraulic pump assembly 48 having four hydraulic rams 48*a*, 48*b*, 48*c*, and 48*d*. Framework 41, hydraulic pump assembly 48, and batteries 481 make up a considerable portion of the mass of the system, although more weight may be added to bottom 41*a* of framework 41, if needed. Concentration of this weight at the lower part of framework 41 is important to the effective operation of the invention since as buoy system 10 is deployed, the concentrated weight at or near bottom 41*a* properly orients submerged unit 40 as it falls toward, impacts, and rests on the bottom.

After submerged unit 40 is on the floor, hydraulic pump assembly 48 actuates hydraulic rams 48*a*, 48*b*, 48*c*, and 48*d* to outwardly displace all four arms 45 from framework 41. Each arm 45 has first and second panels 42 and 43 joined together by hinge 43*a* and hinge 42*a* joins panel 42 to framework 41. Outward displacement by hydraulic pump assembly rotates hinges 42*a* and 43*a* to unfold first and second panels 42 and 43 and rotate them to extend outwardly and create a four-legged, cross-like pattern on the water floor.

At about the same time each spool 31 begins to pay-out line 30 over the outside of rim 41*b* of framework 41 to flotation unit 20, see FIG. 1. When flotation unit 20 is on the surface and submerged unit is on the bottom, lines 30 are no longer being pulled from spools 31. The pawl or similar device of each mechanism 32 engages each spool 31 to stop further rotation so that lines 30 extending from arms 45 hold flotation unit 20 substantially vertically above submerged unit 40. Spools 31 and the restricted lengths of lines 30 collectively restrain the movement of flotation unit 20 and reduce the diameter of the watch circle of flotation unit 20 on the water's surface.

Figure 4:
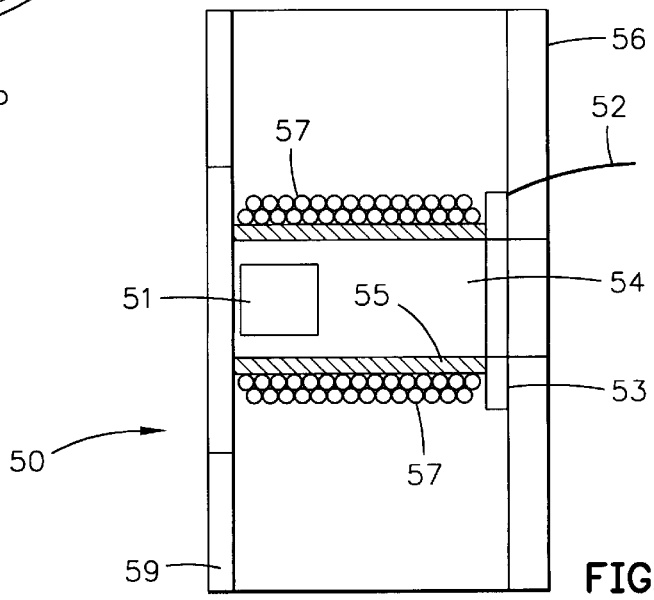
FIG. 4 shows a typical sand spike for anchoring the submerged portion of the buoy system to the bottom surface of the body of water.

Limitation of the extent of the watch circle is further assured by anchoring submerged unit 40 to the floor by providing each arm 45 with sand spike device 50, see FIG. 4. Each sand spike device 50 is shown mounted of a separate panel 43, although it may be mounted on either panel 42 or 43 of each arm 45. When arms 45 are extended by hydraulic pump assembly 48 to lie along the floor along the bottom of the body of water, sand spike devices 50 point metal anchoring slugs 51 toward the sediment of the floor that lies beneath the panels.

A detonation signal is fed over lead 52 to each sand spike 50 to detonate squib 53 and initiate propellant material 54. The exploding propellant material 54 generates pressure in tubular shell 55 that propels metal slug 51 as much as two feet into the floor. Metal slug 51 is connected to petal-shaped penetrator 59, and cable or line 57 attached to each end of petal-shaped penetrator 59 is unwound from spring loaded spool 56 mounted around plastic shell 55. Spring loaded spool 56 automatically tightens each spool line or cable 57 to a predetermined tension. This tension toggles the outer edges of penetrator 59 to embed themselves and be entrenched in the sediment of the floor. Sand spikes 50 could be mounted to extend through framework 41 in addition to or instead of being mounted on arms 45. Four such metal slugs 51 thusly embedded and toggled in the floor anchor submerged unit 40 in place and thereby contribute to reducing the diameter of the watch circle traveled by flotation unit 20.

Optionally, spools 31 and mechanisms 32 could be mounted on flotation unit 20, and each line 30 could be secured to a separate distal end 44 of each arm 45. When flotation unit 20 floats on the surface of the water and submerged unit 40 comes to rest on the floor, lines 30 payed-out from spools 31 are secured by pawls of mechanisms 32 on flotation unit 20 to hold flotation unit 20 substantially vertically above submerged unit 40.

In one typical operational deployment sequence, for example, in 40–10 foot water depths, buoy system 10 is put overboard from a surface craft or from the air (via a fixed wing aircraft, etc.). Just prior to deployment, power is turned on in batteries in flotation unit 20 and submerged unit 40. When buoy system 10 enters the water, the weight distribution of buoy system 10 causes it to sink down to the floor of the body of water bottom-first. After settling on the floor, a control connected to batteries in submerged unit 40 and/or flotation unit 20 provides signals to unlatch release mechanisms 11 which unlatch four arms 45 of submerged unit 40 to free floatation unit 20 from submerged unit 40. Hydraulic rams 48*a*, 48*b*, 48*c*, and 48*d* push out arms 45 until they are completely extended in a cross-like configuration. Lines 30 from spools 31 are deployed and secured by mechanisms 32. Sand spikes 50 on each second panel 43 of submerged unit 40 are initiated, driving each slug 51 deep into the sediment and other material of the floor. Batteries in flotation unit 20 and submerged unit 40 power bulbs 26 and the GPS receiver-transmitter 27 in flotation unit 20 and hydraulic pump assembly 48 in submerged unit 40. Floatation unit 20 floats on the water's surface, where it identifies its position visually via a neon paint scheme and flag 24 and transmits signals representative of its position in GPS P(Y) code coordinates. Buoy system 10 fabricated in accordance with this invention maintains its position over a period of time such that it identifies and transmits its location to within three meters of its actual position.

In accordance with this invention buoy system 10 has the advantage of being self-contained and deployable from various surface or air platforms. Thus, it is a simple matter to deploy it in different water depths (from 40 foot water depths to on top the beach). Buoy system 10 may have an overall height of about 3 meters (9.8 feet) and weigh about 36 kilograms (80 pounds) to allow a single man to manually deploy it and does not require any new or additional equipment. Buoy system 10 also has the capability to maintain its displayed and transmitted position to within three meters of its actual position over a long time period, regardless of the water currents and/or tides.

Buoy system 10 according to this invention marks and maintains its position in VSW (40–10 foot water depths), SZ (10–0 foot water depths), and in BZ to a positional accuracy of 3 meters or less. However, the constituents of buoy system 10 might be modified or otherwise tailored so that it may satisfactorily perform for different tasks, yet such modifications will be within the scope of this inventive concept. For examples: submerged unit 40 can have more or less arms 45 than the disclosed four; submerged unit 40 can use springs or electric motors to open each arm 45 instead of hydraulic pump assembly 48; GPS receiver-transmitter 27 and power source 28 can be located in submerged unit 20 rather than in flotation unit 20, and appropriate signal leads can extend from submerged unit 40 to flotation unit 20; a more accurate GPS receiver can be used than a P(Y) code GPS receiver to further improve accuracy of location; and flotation unit 20 can be marked with other or additional schemes to more clearly identify its position on the water surface, e.g., phosphorescent or infrared paint, etc. or with sound projectors.

Having the teachings of this invention in mind, modifications and alternate embodiments of this invention may be fabricated to have a wide variety of applications in many other environments, e.g., accurate marking of locations in deep ocean recovery operations. Different fabrication materials and shapes of flotation unit 20 and submerged unit 40 could be incorporated to accommodate a variety of applications without departing from the scope of this invention. In addition, some uses of this invention might not require some of the visual location aids or the GPS location capabilities. In this cases, a less complicated design might be more suitable.

The disclosed components and their arrangements as disclosed herein all contribute to the novel features of this invention. This invention provides a reliable and cost-effective means to locate and mark a site. Therefore, buoy system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A buoy system comprising:

a flotation unit to protrude above and below the surface of a body of water to transmit signals representative of location of said flotation unit;

a submerged unit affixed to a surface at the bottom of said body of water having extensions to outwardly reach from a central portion to lie adjacent said surface; and a plurality of lines each connected between a distal part of each of said extensions and said flotation unit.

2. A buoy system according to claim 1 in which said plurality of lines limits the range said flotation unit may traverse in said water.

3. A buoy system according to claim 2 further comprising;

a spool coupled to each of said lines to each deploy and secure one of said lines to maintain said flotation unit substantially vertically above said submerged unit.

4. A buoy system according to claim 3 in which said submerged unit includes an assembly coupled to each of said extensions to displace said extensions outwardly therefrom along said surface at the bottom of said body of water and at least one anchoring device to secure said submerged unit to said surface at the bottom of said body of water.

5. A buoy system according to claim 4 in which said displacing assembly includes a hydraulic pump assembly mounted on said central portion to displace a plurality of hydraulic rams each coupled to separate ones of said extensions, and a separate said anchoring device is mounted on each distal part of said extensions.

6. A buoy system according to claim 5 in which said anchoring device includes at least one sand spike device to anchor said submerged unit to said surface at said bottom.

7. A buoy system according to claim 6 in which said submerged unit includes ballast in said central portion to assure vertical orientation and batteries to power said hydraulic pump assembly.

8. A buoy system according to claim 7 in which said flotation unit includes a electrical power supply and GPS transceiver to transmit said representative signals to indicate true location of said buoy within a range of three meters.

9. A buoy system according to claim 8 in which said flotation unit includes electromagnetic energy radiators and electromagnetic energy reflectors to indicate location of said buoy.

10. A method of marking a location comprising the steps of:

anchoring a submerged unit to a surface at the bottom of a body of water, said anchoring means having extensions outwardly reaching therefrom;

floating a flotation unit on said body of water to transmit signals representative of location; and connecting a tether line between a distal part of each of said extensions and said floating means to maintain said floating means substantially vertically above said anchoring means.

11. A method according to claim 10 further comprising the step of:

displacing said extensions outwardly along said surface by a hydraulic pump assembly.

12. A method according to claim 11 further comprising the step of:

ballasting said submerged unit to maintain vertical orientation.

13. A method according to claim 12 further comprising the step of:

limiting the length of each tether line to position and to secure said flotation unit vertically above said submerged unit.

14. A buoy comprising:

means for anchoring to a surface at the bottom of a body of water, said anchoring means having extensions outwardly reaching therefrom;

means for floating on body of water to transmit signals representative of location; and means for connecting between a distal part of each of said extensions and said floating means to maintain said floating means substantially vertically above said anchoring means.

15. A buoy according to claim 14 further comprising:

means connected to each of said extensions for displacing said extensions outwardly along said surface and at least one anchoring device to secure said submerged unit to said surface.

16. A buoy according to claim 15 further comprising:

means mounted in said anchoring means for ballasting said anchoring means to assume vertical orientation.

17. A buoy according to claim 16 further comprising:

means on said floating means for visually indicating the position of said floating means.

18. A buoy system according to claim 17 in which said connecting means is carried on a spool, deployed therefrom, and secured to maintain said floating means substantially vertically above said anchoring means.

19. A buoy system according to claim 18 further including:

means mounted on said anchoring means for embedding a petal-shaped penetrator in said surface of said bottom to secure by its outer edges said anchoring means to said surface at said bottom.

* * * * *